US011247494B2

(12) United States Patent
Ushiama

(10) Patent No.: US 11,247,494 B2
(45) Date of Patent: Feb. 15, 2022

(54) HEATING DEVICE AND RECORDING APPARATUS

(71) Applicant: SEIKO EPSON CORPORATION, Tokyo (JP)

(72) Inventor: Jun Ushiama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/186,106

(22) Filed: Feb. 26, 2021

(65) Prior Publication Data

US 2021/0268813 A1 Sep. 2, 2021

(30) Foreign Application Priority Data

Feb. 28, 2020 (JP) ..... JP2020-033143

(51) Int. Cl.
*B41J 11/00* (2006.01)

(52) U.S. Cl.
CPC ..... *B41J 11/00216* (2021.01); *B41J 11/0022* (2021.01)

(58) Field of Classification Search
CPC ..... B41J 11/00216; B41J 11/0022; B41F 23/0463; B41F 23/0456; B41F 23/0406; B41F 23/0423
See application file for complete search history.

(56) References Cited

U.S. PATENT DOCUMENTS

2018/0004143 A1* 1/2018 Sasaki ..... G03G 15/605

FOREIGN PATENT DOCUMENTS

JP 2013-159045 A 8/2013
JP 2018-001501 A 1/2018

* cited by examiner

*Primary Examiner* — Bradley W Thies
(74) *Attorney, Agent, or Firm* — Workman Nydegger

(57) ABSTRACT

A medium support portion including a support face that supports a medium, a heater configured to heat a surface of the medium remotely from the support face, an airflow supply unit configured to supply airflow, along the surface of the medium, to a region between the medium and the heater, a plurality of heater support portions that support the heater, and at least one first temperature detection unit located remotely from the support face and configured to detect a spatial temperature in the region that is in contact with the surface of the medium are provided, in which the at least one first temperature detection unit is disposed between two mutually adjacent heater support portions among the plurality of heater support portions.

7 Claims, 4 Drawing Sheets

HEATING DEVICE AND RECORDING APPARATUS

The present application is based on, and claims priority from JP Application Serial Number 2020-033143, filed Feb. 28, 2020, the disclosure of which is hereby incorporated by reference herein in its entirety.

BACKGROUND

1. Technical Field

The present disclosure relates to a heating device including a heater that heats a medium and a recording apparatus.

2. Related Art

For example, JP 2018-1501 A describes a printing apparatus that causes infrared rays from a heating unit and air stream from an air blowing unit to dry, on a guide surface that supports a medium, ink discharged onto a medium M. JP 2013-159045 A also describes that a temperature of infrared rays from a heater can be detected by a thermistor disposed near the heater.

A recording apparatus, which causes the heater to heat and dry the medium while allowing air stream to flow along a surface of the medium, may generate wrinkles at a portion of the medium due to non-uniformity of heat in a width direction of the medium. At a portion where wrinkles occur, the wrinkles disturb air flowing along the surface of the medium, causing turbulent flow to occur.

When a temperature detection unit is disposed facing the portion where wrinkles occur, a part of the turbulent flow is blown to impinge on the temperature detection unit. There is an issue, in the temperature detection unit, in that an accuracy of the temperature detection is easily reduced affected by the turbulent flow impinging on the temperature detection unit.

There is no description of consideration nor suggestion, in JP 2018-1501 A nor JP 2013-159045 A, about the issue due to the occurrence of the wrinkles.

SUMMARY

In order to resolve the above-described issue, a heating device according to the present disclosure includes a medium support portion including a support face that supports a medium, a heater configured to heat a surface of the medium remotely from the support face, an airflow supply unit configured to supply airflow, along the surface of the medium, to a region between the medium and the heater, a plurality of heater support portions that support the heater, and at least one temperature detection unit located remotely from the support face and configured to detect a spatial temperature in the region, in which the at least one temperature detection unit is disposed between two mutually adjacent heater support portions among the plurality of heater support portions.

Further, a recording apparatus according to the present disclosure includes, a medium support portion including a support face that supports a medium, a recording unit configured to perform recording on the medium, a heater configured to heat a surface of the medium remotely from the support face, an airflow supply unit configured to supply airflow, along the surface of the medium, to a region between the medium and the heater, a plurality of heater support portions that support the heater, and at least one temperature detection unit located remotely from the support face and configured to detect a spatial temperature in the region, in which the at least one temperature detection unit is disposed between two mutually adjacent heater support portions among the plurality of heater support portions.

DESCRIPTION OF EXEMPLARY EMBODIMENTS

Figure 1:
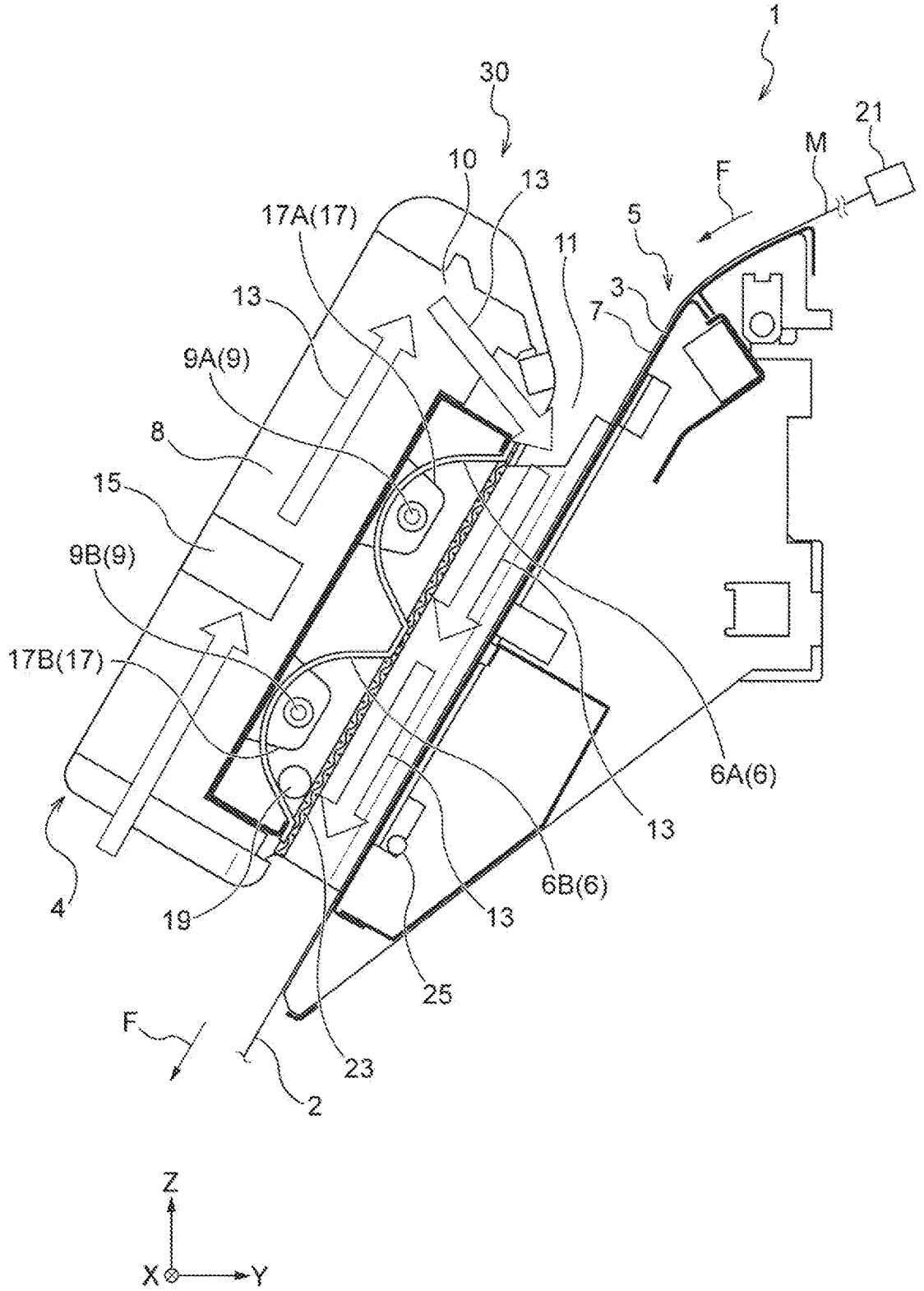
FIG. 1 is a longitudinal cross-sectional view schematically illustrating a recording apparatus including a heating device according to Embodiment 1.

First, the present disclosure will be schematically described below.

A first aspect of a printing apparatus according to the present disclosure for resolving the above-described issue includes a medium support portion including a support face that supports a medium, a heater configured to heat a surface of the medium remotely from the support face, an airflow supply unit configured to supply airflow, along the surface of the medium, to a region between the medium and the heater, a plurality of heater support portions that support the heater, and at least one first temperature detection unit located remotely from the support face and configured to detect a spatial temperature in the region, in which the at least one first temperature detection unit is disposed between two mutually adjacent heater support portions among the plurality of heater support portions.

A portion between the two mutually adjacent heater support portions among the plurality of heater support portions, a temperature of the medium based on the heating is higher than a temperature of a portion facing the heater support portion. Accordingly, the medium at the portion stretches, that is, wrinkles are less likely to occur. On the other hand, the portion facing the heater support portion having a low temperature based on the heating is affected by the elongation from surroundings, which causes wrinkles to easily occur.

According to the above aspect, the at least one first temperature detection unit is disposed between the two mutually adjacent heater support portions among the plurality of heater support portions. Accordingly, even if wrinkles occur by the heating in the medium, the spatial temperature can be detected with high accuracy in a state where there is little affection from a turbulent flow due to the wrinkles because the first temperature detection unit is located at a portion of the medium where wrinkles hardly occur. Because the spatial temperature is correlated with the temperature of the medium, it is thus possible to accurately detect the temperature of the medium.

A heating device according to a second aspect of the present disclosure is the heating device according to the first aspect, in which two or more of the first temperature detection units are arranged between the two mutually adjacent support portions among the plurality of heater support portions. In other words, the first temperature detection units are arranged at two or more locations between the two mutually adjacent heater support portions.

According to the above aspect, two or more of the first temperature detection units are arranged between the two mutually adjacent heater support portions among the plurality of heater support portions. This allows the two or more of the first temperature detection units to detect a spatial temperature corresponding to between the two mutually adjacent heater support portions without being affected by the wrinkles. Thus, the spatial temperature can be detected with higher accuracy by taking an average of temperatures of the medium that are detected at two or more locations between the two mutually adjacent heater support portions. As a consequence, the temperature of the medium can be detected with high accuracy.

A heating device according to a third aspect of the present disclosure is the heating device according to the first aspect or the second aspect, in which a transport unit configured to transport the medium is provided, and the at least one first temperature detection unit is disposed downstream of the heater with respect to a transport direction in which the medium is transported.

According to the above aspect, the at least one first temperature detection unit is disposed downstream of the heater with respect to the transport direction in which the medium is transported. This allows the temperature detection by the first temperature detection unit to be performed in a state where the medium is sufficiently heated. That is, the temperature detection by the first temperature detection unit is performed at a position where a correlation between the spatial temperature and the temperature of the medium is high. As a consequence, an accuracy of the temperature detection of the medium can be improved.

A recording apparatus according to a fourth aspect of the present disclosure is the recording apparatus according to the first aspect or the second aspect, in which a plurality of the airflow supply units are arranged in a direction intersecting a flow direction of the airflow, and the at least one temperature detection unit is disposed upstream of the heater with respect to in the flow direction of the airflow.

In the above aspect, the plurality of the airflow supply units are arranged in the direction intersecting the flow direction of the airflow. This makes the airflow uniform in a width direction of the medium. However, if any one of the plurality of the airflow supply units fails to operate properly, the airflow at a position corresponding to the failed airflow supply units becomes weaker than the airflow at other positions in the width direction of the medium.

According to the above aspect, the temperature detection unit corresponding to a failure portion of the airflow supply units can detect an increase in the spatial temperature based on weakening of the airflow. This makes it possible to easily detect whether the airflow supply units have failed in addition to performing accurate detection of the spatial temperature as in the first aspect and the second aspect. This further makes it possible to easily specify which among the plurality of the airflow supply units has failed. This makes it possible to immediately take measures against the failure of the airflow supply units.

A recording apparatus according to a fifth aspect of the present disclosure is the recording apparatus according to any one of the first to fourth aspects, in which a space between the heater and the region, along the surface of the medium, in which the airflow flows is partitioned by a net body and the at least one first temperature detection unit is disposed on a side of the heater with respect to the net body.

According to the above aspect, the at least one first temperature detection unit is disposed on the side of the heater with respect to the net body, which reduces a risk of an operator inadvertently making contact with the first temperature detection unit when setting the medium on a support face of the medium support portion, when performing medium jam processing, or the like.

A recording apparatus according to a sixth aspect of the present disclosure is the recording apparatus according to any one of the first to fifth aspects, in which the medium support portion includes at least one second temperature detection unit in addition to the first temperature detection unit, and the at least one second temperature detection unit is disposed at a position corresponding to between the two mutually adjacent heater support portions among the plurality of heater support portions.

According to the above aspect, the medium support portion includes the second temperature detection unit in addition to the first temperature detection unit, and the at least one second temperature detection unit is disposed at the position corresponding to between the two mutually adjacent heater support portions among the plurality of heater support portions. The second temperature detection unit, which is disposed at the medium support portion, is configured to detect a temperature of the medium support portion based on heat escaping from the heated medium through the medium support portion. This allows for a detection of the temperature of the medium with higher accuracy taking account for the heat escaping from the medium when determining the temperature of the medium from the spatial temperature detected by the first temperature detection unit.

A recording apparatus according to a seventh aspect of the present disclosure includes a medium support portion including a support face that supports a medium, a recording unit configured to perform recording on the medium, a heater configured to heat a surface of the medium remotely from the support face, an airflow supply unit configured to supply airflow, along the surface of the medium, to a region between the medium and the heater, a plurality of heater support portions that support the heater, and at least one first temperature detection unit located remotely from the support face and configured to detect a spatial temperature in the region, in which the at least one first temperature detection unit is disposed between two mutually adjacent heater support portions among the plurality of heater support portions.

According to the above aspect, the recording apparatus can achieve advantageous effects of the respective aspects of the heating device.

Embodiment 1

Hereinafter, a recording apparatus including a heating device of Embodiment 1 according to the present disclosure will be described in detail with reference to FIGS. 1 to 4.

In the following description, three mutually orthogonal axes are designated as an X axis, Y axis, and Z axis, respectively, as illustrated in the figures. A Z axis direction corresponds to a vertical direction. An X axis direction and a Y axis direction correspond to horizontal directions. Note that a front and back direction of the recording apparatus is designated as the Y axis direction, and a width direction is designated as the X axis direction.

FIG. 1 illustrates an inkjet printer as an example of a recording apparatus 1. The recording apparatus 1 is configured to discharge ink onto the medium M to record various types of information. The recording apparatus 1 includes a heating device 30. The heating device 30 is configured to heat and dry the ink discharged onto the medium M.

Examples of the medium M include various types of materials such as paper (roll paper, single sheet paper) and textile (woven fabric, cloth, and the like).

In Embodiment 1, the heating device 30 includes a medium support portion 5 including a support face 3 that supports the medium M, at least one heater 9 configured to heat a surface 7 of the medium M remotely from the support face 3, an airflow supply unit 15 configured to supply airflow 13, along the surface 7 of the medium M, to a region 11 between the medium M and the heater 9, and a plurality of heater support portions 17, 17, . . . that support the heater 9.

The heating device 30 further includes at least one first temperature detection unit 19 configured to detect a spatial temperature in the region 11 that is in contact with the surface 7 of the medium M remotely from the support face 3. The at least one first temperature detection unit 19 is disposed between two mutually adjacent heater support portions 17 and 17 among the plurality of heater support portions 17, 17, . . . .

Medium Support Portion

As illustrated in FIG. 1, the medium support portion 5 includes the support face 3 that is formed flat. The support face 3 is at a position for receiving heating from the heater 9 and supports, from a side of a back surface 2, the medium M being transported by a transport unit 21 in a transport direction F. The medium support portion 5 is composed of a material having a relatively large thermal conductivity, such as aluminum or SUS.

In Embodiment 1, the support face 3 is configured as an inclined surface inclined with respect to the horizontal direction. Note that the support face 3 is not limited to the inclined surface that is illustrated, and may also be a horizontal surface or a vertical surface.

A recording head of which an illustration is omitted is provided upstream in the transport direction F of the medium support portion 5. The recording head discharges ink onto the medium M, to record predetermined information.

The medium M onto which the ink was discharged, when transported by the transport unit 21 to reach onto the support face 3 of the medium support portion 5, is heated by the heater 9 and a drying process of the ink is performed. The medium M on which the drying process was performed is further fed downstream to be wound by a non-illustrated winding roller. Alternatively, on some mediums M, a cutting process is performed using a cutter.

Heater

Figure 2:
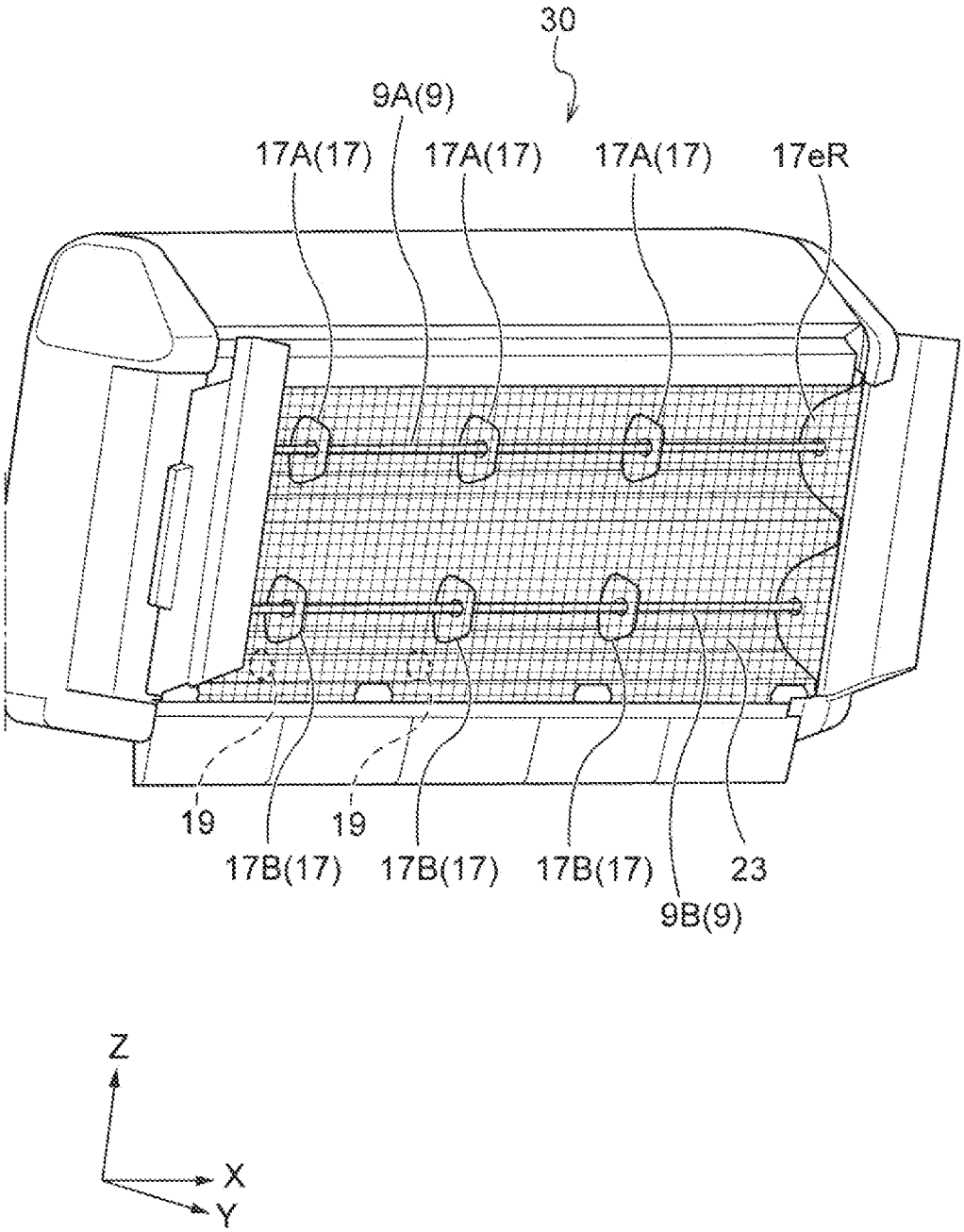
FIG. 2 is a perspective view illustrating a main part of a section of a heating device according to Embodiment 1.
Figure 3:
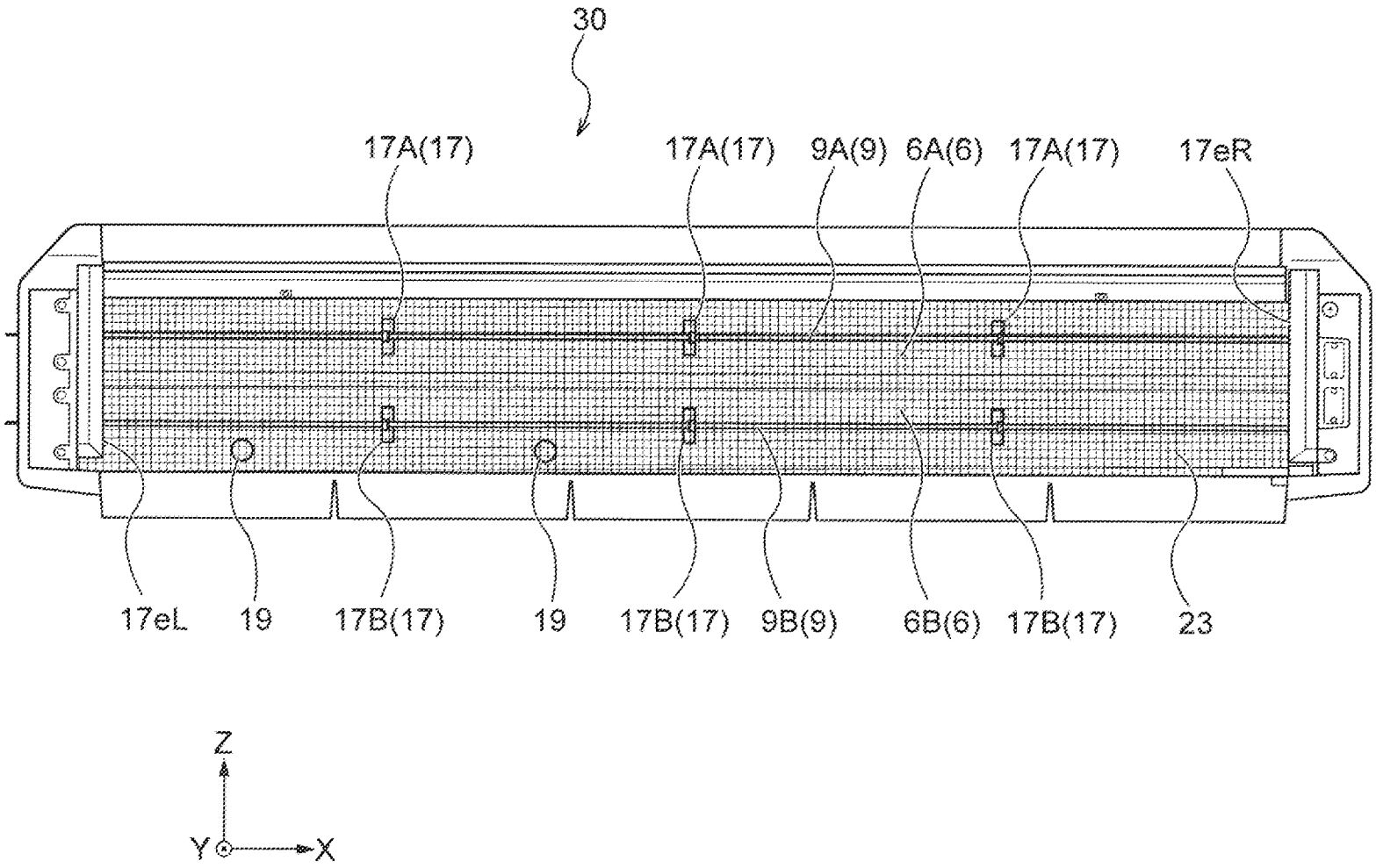
FIG. 3 is a front view of a section of a heating device according to Embodiment 1.

As illustrated in FIGS. 2 and 3, in Embodiment 1, an infrared heater of a rod shape having a long length is used for the heater 9.

A heating drying unit 4 is provided facing the support face 3 of the medium support portion 5. The heating drying unit 4 is configured to dry the ink discharged onto the medium M. The heater 9, which forms one of main components of the heating drying unit 4, is disposed facing the support face 3 of the medium support portion 5.

In FIGS. 1 and 2, the reference sign of 6 denotes a reflective plate. Some of electromagnetic waves emitted from the infrared heater are directed in a direction opposite to the medium M. The reflective plate 6 is for reflecting the some of the electromagnetic waves to irradiate, with the reflected electromagnetic waves, the medium M on the support face 3. The reflective plate 6 is constituted of two concave mirrors, one of which is a reflective plate 6A for a heater 9A and the other is a reflective plate 6B for a heater 9B.

In Embodiment 1, two heaters 9 are provided. The two heaters 9 include the heater 9A located upstream in the transport direction F of the medium M, and the heater 9B located downstream.

The heaters 9A and 9B of rod shapes are both provided such that longitudinal directions of the rod shapes are aligned in a direction intersecting the transport direction F. That is, the heaters 9A and 9B of rod shapes are provided along a width direction of the medium M.

Further, the at least one heater 9 is controlled by a non-illustrated control unit based on a detection result of a temperature of the medium M by at least one of the first temperature detection unit 19 or a second temperature detection unit 25 that will be described later. Specifically, the at least one heater 9 is PID controlled so that a difference (deviation) between the temperature of the medium M detected by the at least one of the first temperature detection unit 19 or the second temperature detection unit 25 and a predetermined target temperature approximates to zero whenever possible.

Heater Support Portion

As illustrated in FIG. 3, one end (left side of FIG. 3) of the heaters 9A and 9B of rod shapes is held by an end-portion heater support portion 17*e*L constituted by a single member. The other end (right side of FIG. 3) of the heaters 9A and 9B of rod shapes is held by an end-portion heater support portion 17*e*R constituted by a single member.

In Embodiment 1, the heater 9A of a rod shape on one hand is held at portions other than its both of the ends by three heater support portions 17A so as not to be deflected downward by its own weight. The heater 9B of a rod shape on the other hand is also held at portions other than its both of the ends by three heater support portions 17B so as not to be deflected downward by its own weight. The respective three heater support portions 17A and 17B are both arranged at substantially equal intervals and at approximately the same position in the width direction of the medium M. In Embodiment 1, the plurality of heater support portions 17, 17, . . . are constituted by the respective three heater support portions 17A and 17B, the end-portion heater support portion 17*e*L, and the end-portion heater support portion 17*e*R. The plurality of heater support portions 17, 17, . . . are all composed of a metal material such as SUS, for example.

Note that the number of the respective heater support portions 17A and 17B that are arranged is not limited to three, and may be two, or four or more.

Airflow Supply Unit

As illustrated in FIG. 1, at least one airflow supply unit 15 is configured to supply the airflow 13, along the surface 7 of the medium M, to the region 11 between the medium M and the heater 9 (9A, 9B).

In Embodiment 1, four airflow supply units 15 are arranged, in a direction intersecting a flow direction (the same as the transport direction F) in which the airflow 13 flows, in a region 8 on an opposite side of the reflective plate 6 from the heater 9. Specifically, the four airflow supply units 15 are arranged at approximately equal intervals in the width direction of the medium M. This makes the airflow 13 uniform in the width direction of the medium M. Here, a fan is used for the airflow supply unit 15.

The region 8 communicates with the region 11 via a turning region 10. The region 8 is configured to intake outside air. In other words, the outside air is suctioned by the airflow supply unit 15 constituted of the fan to allow the airflow 13 to flow through the region 8, the turning region 10, and the region 11.

First Temperature Detection Unit

The at least one first temperature detection unit 19 is located remotely from the support face 3. The at least one first temperature detection unit 19 detects the spatial temperature in the region 11 that is in contact with the surface 7 of the medium M. Here, a thermistor is used for the at least one first temperature detection unit 19.

As illustrated in FIGS. 2 and 3, in Embodiment 1, two first temperature detection units 19 are provided. The two first temperature detection units 19 are arranged at two locations of between two mutually adjacent heater support portions 17*e*L and 17B, and between two mutually adjacent heater support portions 17B and 17B, respectively. Note that the first temperature detection unit 19 disposed between the two mutually adjacent heater support portions 17 and 17 is disposed at, but not limited to, the two locations, and may be disposed at one location, or three or more locations. Also, in Embodiment 1, a plurality of the first temperature detection units 19 are provided each of between the two mutually adjacent heater support portions 17*e*L and 17B, and between the two mutually adjacent heater support portions 17B and 17B. In other words, the plurality of the first temperature detection units are arranged corresponding to each of a plurality of locations between the two mutually adjacent heater support portions 17*e*L and 17B, and a plurality of locations between the two mutually adjacent heater support portions 17B and 17B.

In addition, as illustrated in FIG. 1, in Embodiment 1, the first temperature detection unit 19 is disposed downstream of the heaters 9A and 9B with respect to the transport direction F in which the medium M is transported. Specifically, the first temperature detection unit 19 is disposed inside the reflective plate 6B and at a position diagonally downward of the heater 9B. Note that a shielding member may be provided between the first temperature detection unit 19 and the heater 9 so that the first temperature detection unit 19 does not directly receive electromagnetic waves from the heater 9.

Net Body

In Embodiment 1, a space between the heater 9 and the region 11 in which the airflow 13 along the surface 7 of the medium M flows is partitioned by a net body 23. For the net body 23. wire rods knitted in a lattice shape are used. Further, the first temperature detection unit 19 is disposed on a side of the heater 9 with respect to the net body 23.

Second Temperature Detection Unit

In Embodiment 1, the medium support portion 5 includes at least one second temperature detection unit 25 in addition to the first temperature detection unit 19. In Embodiment 1, two second temperature detection units 25 and 25 are provided.

A position at which the second temperature detection unit 25 is provided is an inward position that is not exposed from the support face 3, which is a position corresponding to the first temperature detection unit 19 and a position corresponding to between the two mutually adjacent heater support portions among the plurality of heater support portions 17, 17. Here, a thermistor is used for the second temperature detection unit 25 as well.

Description on Operations and Advantageous Effects of Embodiment 1

Operations of the heating device 30 and the recording apparatus 1 of Embodiment 1 will be described with reference to FIGS. 1 to 3.

The recording head of which an illustration is omitted discharges ink onto the medium M, upstream in the transport direction F of the medium support portion 5 of the heating device 30, to record predetermined information. The medium M onto which the ink was discharged from the transport unit 21, when transported to reach onto the support face 3 of the medium support portion 5, is heated by the heater 9 of the heating device 30 and the drying process of the ink is performed.

(1) As described above, in the heating device 30 of Embodiment 1, between the two mutually adjacent heater support portions 17 and 17 among the plurality of heater support portions 17, 17, . . . , the temperature of the medium M based on the heating is higher than the temperature of the portion facing the heater support portion 17. This is because the electromagnetic waves from the heater 9 are hardly blocked by the plurality of heater support portions 17, 17, . . . . Accordingly, the medium M at the portion stretches during the heating and drying, that is, wrinkles are less likely to occur. On the other hand, the portion facing the heater support portion 17 having a low temperature based on the heating is affected by the elongation from surroundings, which causes wrinkles to easily occur.

According to Embodiment 1, the at least one first temperature detection unit 19 is disposed between the two mutually adjacent heater support portions 17 and 17 among the plurality of heater support portions 17, 17, . . . . Accordingly, even if wrinkles occur by the heating in the medium M, the spatial temperature can be detected with high accuracy in a state where there is little affection from a turbulent flow due to the wrinkles because the first temperature detection unit 19 is located at a portion of the medium M where wrinkles hardly occur. Because the spatial temperature is correlated with the temperature of the medium M, it is thus possible to accurately detect the temperature of the medium M.

As the recording apparatus 1 that is provided with the heating device 30, advantageous effects based on the heating device 30 can be achieved in the recording apparatus 1. Specifically, the temperature of the medium M is detected with high accuracy, which causes a control of the heater 9 to be performed with high accuracy as well. This makes it possible to fix an image onto the medium M with high accuracy, improving a quality of the image. In the following description as well, the advantageous effects based on the heating device 30 can be achieved in the recording apparatus 1.

(2) A period of wrinkles occurring in the medium M may not coincide with an arrangement period (arrangement interval) of the plurality of heater support portions 17, 17, . . . , depending on a type of the medium M. Specifically, the period of the wrinkles occurring in the medium M may be greater than the arrangement period (arrangement interval) of the plurality of heater support portions 17, 17, . . . . According to Embodiment 1, two or more first temperature detection units 19 are arranged between the two mutually adjacent heater support portions 17 and 17 among the plurality of heater support portions 17, 17, . . . . This allows the two or more first temperature detection units 19 to detect the spatial temperature corresponding to between the heater support portions 17 and 17 without being affected by the wrinkles. Thus, the spatial temperature can be detected with higher accuracy by taking an average of temperatures of the medium that are detected at two or more locations between the heater support portions 17 and 17. As a consequence, the temperature of the medium M can be detected with high accuracy. Further, even when the period of the wrinkles occurring in the medium M does not coincide with the arrangement period (arrangement interval) of the plurality of heater support portions 17, 17, . . . , depending on the type of the medium M, the spatial temperature can be detected with higher accuracy.

According to Embodiment 1, the at least one first temperature detection unit 19 is disposed downstream of the heater 9 with respect to the transport direction F in which the medium M is transported. This allows the temperature detection by the first temperature detection unit 19 to be performed in a state where the medium M is sufficiently heated. That is, the temperature detection by the first temperature detection unit 19 is performed at a position where a correlation between the spatial temperature and the temperature of the medium M is high. As a consequence, an accuracy of the temperature detection of the medium M can be improved.

According to Embodiment 1, the at least one first temperature detection unit 19 is disposed on the side of the heater 9 with respect to the net body 23, which reduces a risk of an operator inadvertently making contact with the first temperature detection unit 19 when setting the medium M on the support face 3 of the medium support portion 5, when performing medium jam processing, or the like.

According to Embodiment 1, the medium support portion 5 includes the at least one second temperature detection unit 25 in addition to the first temperature detection unit 19, and the at least one second temperature detection unit 25 is disposed at the position corresponding to between the two mutually adjacent heater support portions 17 and 17 among the plurality of heater support portions 17, 17, . . . . The second temperature detection unit 25, which is disposed at the medium support portion 5, is configured to detect a temperature of the medium support portion 5 based on heat escaping from the heated medium M through the medium support portion 5. Wrinkles are less likely to occur between the two mutually adjacent heater support portions 17 and 17 among the plurality of heater support portions 17, 17, In other words, at the position corresponding to between the two mutually adjacent heater support portions 17 and 17 in the medium support portion 5, the medium M hardly floats from the medium support portion 5. This allows for a detection of the temperature of the medium M with higher accuracy taking account for the heat escaping from the heated medium M when determining the temperature of the medium M from the spatial temperature detected by the first temperature detection unit 19. In addition, at the position corresponding to between the two mutually adjacent heater support portions 17 and 17 in the medium support portion 5, the medium M hardly floats from the medium support portion 5, which allows for the detection of the heat escaping from the heated medium M with higher accuracy.

Embodiment 2

Next, the heating device 30 of Embodiment 2 according to the present disclosure will be described based on the schematic view of FIG. 4. Note that common components are referenced using like numbers, and no descriptions for such components are provided below. Also, operations and advantageous effects that are same as those of Embodiment 1 will also be omitted.

Figure 4:
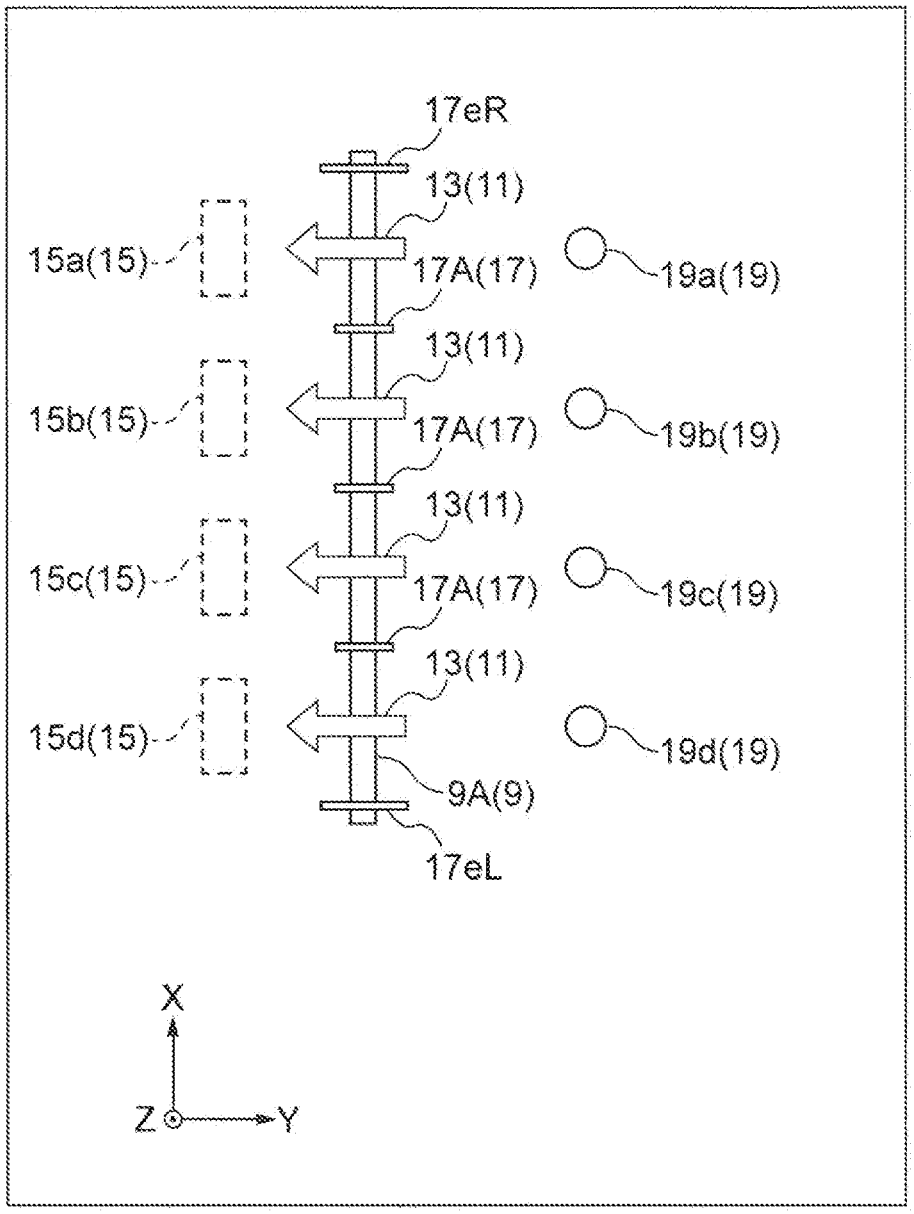
FIG. 4 is a schematic view illustrating a heating device according to Embodiment 2.

The schematic view of FIG. 4 illustrates relative positions of the heater 9A, the first temperature detection unit 19, the airflow 13 (the airflow 13 located in the region 11), and the airflow supply unit 15, when viewing in a direction in which the heater 9A, the region 11, and the support face 3 are located where the viewpoint is located on a side of the airflow supply unit 15.

In Embodiment 2, the first temperature detection unit 19 is disposed upstream of the heaters 9 (9A, 9B) with respect to a flow direction in which the airflow 13 flows. With reference to FIG. 1, the first temperature detection unit 19 is disposed, obliquely upward of the heater 9A, inside the reflective plate 6A. Note that in FIG. 1, no illustration is given of this state.

The description will be given again with reference to FIG. 4. A plurality of the airflow supply units 15 are arranged in the width direction of the medium M, which coincides with a direction intersecting the flow direction in which the airflow 13 flows in the region 11. In Embodiment 2, four airflow supply units 15*a*, 15*b*, 15*c*, and 15*d* are arranged at equal intervals in the width direction. Note that it goes without saying that the number of the airflow supply units 15 is not limited to four.

Also, the temperature detection unit 19 is disposed upstream of the heater 9A with respect to the flow direction in which the airflow 13 flows. In Embodiment 2, four temperature detection units 19 are provided. Note that it goes without saying that the number of the first temperature detection units 19 is not limited to four.

One temperature detection unit 19*a* is located at a position corresponding to the airflow supply unit 15*a*. Similarly, a temperature detection unit 19*b* is located at a position corresponding to the airflow supply unit 15*b*, a temperature detection unit 19*c* is located at a position corresponding to the airflow supply unit 15*c*, and a temperature detection unit 19*d* is located at a position corresponding to the airflow supply unit 15*d*.

In Embodiment 2, the four airflow supply units 15*a*, 15*b*, 15*c*, and 15*d* are arranged in the direction intersecting the flow direction in which the airflow 13 flows. This makes the airflow 13 uniform in the width direction of the medium M.

However, if any one of a plurality of the airflow supply units 15*a*, 15*b*, 15*c*, and 15*d* fails to operate properly, the airflow 13 at a position corresponding to the failed airflow supply unit becomes weaker than the airflow 13 at other positions in the width direction of the medium M. For example, when the airflow supply unit 15*b* fails, the airflow 13 at a position corresponding to the failed airflow supply unit 15*b* becomes weaker than the airflow 13 at other positions.

According to Embodiment 2, the temperature detection unit 19*b* corresponding to a failure portion (for example, the airflow supply unit 15*b*) of the airflow supply units 15*a*, 15*b*, 15*c*, and 15*d* can detect an increase in the spatial temperature based on weakening of the airflow 13. This makes it possible to easily detect whether the airflow supply units 15*a*, 15*b*, 15*c*, and 15*d* have failed in addition to performing accurate detection of the spatial temperature as in Embodiment 1. This further makes it possible to easily specify which among the plurality of the airflow supply units 15*a*, 15*b*, 15*c*, and 15*d* has failed. This makes it possible to immediately take measures against a failure of the airflow supply units 15*a*, 15*b*, 15*c*, and 15*d*.

Other Embodiments

The heating device 30 and the recording apparatus 1 according to Embodiments 1 and 2 of the present disclosure is based on the configuration described above. However, as a matter of course, modifications, omission, and the like may be made to a partial configuration without departing from the gist of the disclosure of the present application.

In Embodiment 1 and Embodiment 2 described above, a structure is described in which the first temperature detection unit 19 is disposed only at a location between the two mutually adjacent heater support portions 17 and 17 among the plurality of heater support portions 17, 17, . . . . The first temperature detection unit 19 may be disposed, in addition to the above location, at a location other than the location between the two mutually adjacent heater support portions 17 and 17 among the plurality of heater support portions 17, 17, . . . .

Further, the second temperature detection unit 25 may be provided in Embodiment 2 as well.

The heater 9 may not be of a rod shape. For example, the heater 9 of a circular shape may be used.

What is claimed is:

1. A heating device, comprising:

a medium support portion including a support face that supports a medium;

a heater configured to heat a surface of the medium remotely from the support face;

an airflow supply unit configured to supply airflow, along the surface of the medium, to a region between the medium and the heater;

a plurality of heater support portions that support the heater; and at least one first temperature detection unit away from the support face and configured to detect a spatial temperature in the region, wherein the at least one first temperature detection unit is disposed between two mutually adjacent heater support portions among the plurality of heater support portions.

2. The heating device according to claim 1, wherein two or more of the first temperature detection units are arranged between the two mutually adjacent heater support portions among the plurality of heater support portions.

3. The heating device according to claim 1, comprising a transport unit configured to transport the medium wherein the at least one first temperature detection unit is disposed downstream of the heater in a transport direction in which the medium is transported.

4. The heating device according to claim 1, wherein a plurality of the airflow supply units are arranged in a direction intersecting a flow direction of the airflow, and the at least one first temperature detection unit is disposed upstream of the heater in the flow direction of the airflow.

5. The heating device according to claim 1, wherein a space between the heater and the region along the surface of the medium is partitioned by a net body and the at least one first temperature detection unit is disposed on a side of the heater with respect to the net body.

6. The heating device according to claim 1, wherein the medium support portion includes at least one second temperature detection unit in addition to the first temperature detection unit, and the at least one second temperature detection unit is disposed at a position corresponding to a position between the two mutually adjacent heater support portions among the plurality of heater support portions.

7. A recording apparatus, comprising:

a medium support portion including a support face that supports a medium;

a recording unit configured to perform recording on the medium;

a heater configured to heat a surface of the medium remotely from the support face;

an airflow supply unit configured to supply airflow, along the surface of the medium, to a region between the medium and the heater;

a plurality of heater support portions that support the heater; and at least one first temperature detection unit located remotely from the support face and configured to detect a spatial temperature in the region, wherein the at least one first temperature detection unit is disposed between two mutually adjacent heater support portions among the plurality of heater support portions.

* * * * *